United States Patent [19]

Minami et al.

[11] 4,108,121

[45] Aug. 22, 1978

[54] CLOSED LOOP MIXTURE CONTROL SYSTEM USING A TWO-BARREL CARBURETOR

[76] Inventors: Hidehiro Minami, No. 1403, Matano-cho, Totsuka-ku, Yokohama City; Makio Waku, 1-22-6,, Moto-machi, Urawa City, both of Japan

[21] Appl. No.: 665,257

[22] Filed: Mar. 9, 1976

[30] Foreign Application Priority Data

Mar. 24, 1975 [JP] Japan ..... 50-39116

[51] Int. Cl.[2] ..... F02D 35/00

[52] U.S. Cl. ..... 123/119 EC; 123/127; 261/23 A; 261/41 C; 261/121 B

[58] Field of Search ..... 60/276, 285; 123/127, 123/119 R, 119 EC; 261/121 B, 23 A, 41 C

[56] References Cited

U.S. PATENT DOCUMENTS

| | | | |
|---|---|---|---|
| 3,186,691 | 6/1965 | Manning | 261/23 A |
| 3,250,264 | 5/1966 | Bartholomew | 261/23 A |
| 3,317,195 | 5/1967 | Bickhaus | 261/23 A |
| 3,364,911 | 1/1968 | Baudry | 123/127 |
| 3,730,496 | 5/1973 | Morgenroth | 261/23 A |
| 3,861,366 | 1/1975 | Masaki | 123/119 R |
| 3,899,551 | 8/1975 | Korte | 123/124 B |
| 3,906,910 | 9/1975 | Szlaga | 123/119 R |
| 3,921,612 | 11/1975 | Aono | 123/119 R |

*Primary Examiner*—Douglas Hart

*Attorney, Agent, or Firm*—Robert E. Burns; Emmanuel J. Lobato; Bruce L. Adams

[57] ABSTRACT

A closed loop mixture control system for an internal combustion engine includes a two-barrel carburetor having a primary throttle and a secondary throttle which is adapted to be automatically brought into action when the primary venturi depression reaches a predetermined value. An exhaust composition sensor is provided to control the air-fuel ratio through the primary barrel so that the conversion efficiency of a catalytic convertor is at a maximum during the time prior to the operation of the secondary throttle.

7 Claims, 6 Drawing Figures

CLOSED LOOP MIXTURE CONTROL SYSTEM USING A TWO-BARREL CARBURETOR

This is a division of application Ser. No. 636,184, filed Nov. 28, 1975, and now U.S. Pat. No. 4,060,058.

BACKGROUND OF THE INVENTION

The present invention relates generally to two-barrel carburetors, and specifically it relates to a closed loop air-fuel mixture control system employing such carburetors.

The concept of closed loop air-fuel mixture control is known as an effective means for controlling air-fuel mixture at the stoichiometric air-fuel ratio. In the closed loop control, a zirconium dioxide sensor is usually employed as a means for detecting the oxygen concentration of the exhaust emissions as a measure of air-fuel ratio at the entry to a three-way catalytic convertor which works at the maximum efficiency when the air-fuel ratio is at the stoichiometric value. The zirconium dioxide sensor delivers a signal which changes sharply in amplitude at stoichiometry, the signal being modified into a form appropriate for controlling the air-fuel metering device to adjust the mixture ratio at the stoichiometric value.

If it is desired to apply this concept to a two-barrel carburetor, separate control units may be required for the primary and secondary metering devices. Since the primary barrel supplies mixture for idling, light load and cruising at part throttle, and also for full throttle operation at low speeds, if the vehicle is operated mainly under such conditions, it would be uneconomical to provide closed loop control circuits separately to the primary and secondary metering devices.

SUMMARY OF THE INVENTION

Therefore, an object of the invention is to economically operate a two-barrel carburetor on the closed loop principle by making advantage of the fact that the secondary throttle is brought into action only after the primary venturi depression reaches a predetermined value and that the emission problem is more serious prior to the time the secondary throttle is brought into operation than after it is operated.

According to the invention, closed loop control is provided only for the primary metering system associated with the primary barrel, and the secondary metering system associated with the secondary barrel is operated in conventional manner to save the cost of providing a separate control unit to the secondary metering system.

Another object of the invention is to enhance the ability of the closed loop control circuit to precisely follow up the variations of actual air-fuel mixture by having a smaller cross section for the primary barrel than that of the secondary barrel so that the primary venturi depression tends to lower than the depression at the secondary venturi to thereby effectively withdraw fuel into the primary barrel operated on the closed loop control principle.

In the closed loop feedback operation, on-off electromagnetic control valves are preferred to analog displacement type valves for use in the fuel metering system because of their lower cost than the latter. However, the operating frequency of the on-off valves must be chosen to differ from the revolution per unit time of the engine since the closeness of the two rates of repetitive operation would result in instability of the system.

A further object of the present invention is to provide a closed loop control unit for a carburetor having a main nozzle in the venturi portion and an auxiliary or idling port in the closed position of the throttle, in which the auxiliary port is supplied with mixture at a first control rate higher than the revolution per unit time of the engine at lower speeds and the main nozzle is supplied with mixture at a second rate outside of the revolution per unit time of the engine at medium to higher speeds.

BRIEF DESCRIPTION OF THE DRAWINGS

These and other objects, features and advantages of the present invention will be understood from the following description taken in conjunction with the accompanying drawings, in which.

DESCRIPTION OF THE PREFERRED EMBODIMENTS

Figure 1:
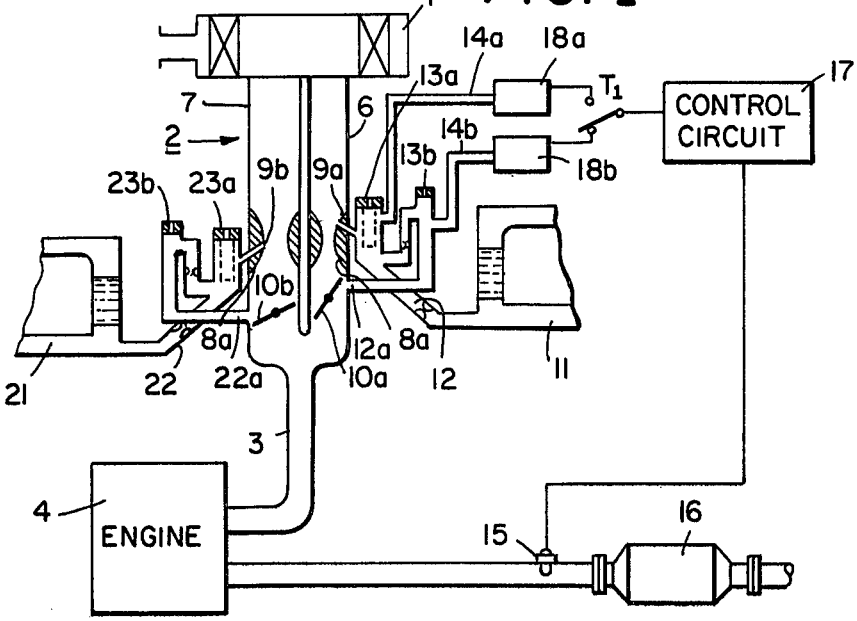
FIG. 1 illustrates an embodiment of the present invention the primary metering system of a two-barrel carburetor is shown provided with a feedback control function.

Reference is now made to FIG. 1 in which an embodiment of the present invention is illustrated. Numeral 1 designates an air cleaner, 2, a two barrel carburetor, 3, an air intake passage connected to the engine 4. The carburetor 2 comprises a primary throttle barrel 6 and a secondary throttle barrel 7. A primary float chamber is shown at 11 with its fuel outlet 12 connected to air bleeds 13*a* and 13*b*. The air bleed 13*a* is connected to the main nozzle 9*a* of primary barrel 6 at the venturi 8*a*, and the air bleed 13*b* to the auxiliary or slow-speed port 12*b*. The air bleeds 13*a* and 13*b* are further connected to air supply on-off electromagnetic valves 18*a* and 18*b* through auxiliary air bleeds 14*a* and 14*b*, respectively. A secondary float chamber is shown at 21 with its fuel outlet 22 connected to air bleeds 23*a* and 23*b*, the air bleed 23*a* being connected to the main nozzle 9*b* of the secondary barrel 7 at the venturi 8*b* and the air bleed 23*b* being connected to the auxiliary or slow-speed port 22*a*.

A composition sensor 15 such as zirconium dioxide sensor is connected to the exhaust pipe 5 to detect the oxygen concentration of the exhaust gases from the engine 4 and provide an output signal which changes sharply in amplitude at the stoichiometric air-fuel ratio. The oxygen sensor 15 feeds its output to a control circuit 17 which converts it into appropriate pulses to control the opening time of the valves 18*a* and 18*b*.

The primary barrel 6 supplies mixture for idling, light load and cruising at part throttle, and also for full throttle operation at low speeds. When power demand exceeds that provided by the primary barrel 6, the secondary throttle 10*b* is brought into action automatically. When the sensed oxygen concentration is above the preset value, the control circuit 17 would adjust the opening time of the valves 18*a* and 18*b* to enrich the mixture so that the mixture is controlled at the stoichiometric value. A catalytic convertor 16 is provided to convert the emissions to harmless water and carbon dioxide. With the mixture being controlled at stoichiometry, the catalytic convertor operates at its maximum efficiency.

When the depression at the primary venturi 8*a* reaches a certain value, a diaphragm (not shown) is drawn upwards opening the secondary throttle 10*b* by a linkage (not shown). Therefore, the primary metering system functions as a separate carburetor on the feedback control principle so long as the secondary throttle 10*b* remains in the closed position, while the secondary metering system operates in the conventional manner from that point onward simultaneously with the primary system.

In accordance with the invention, the diametrical cross-sectional dimension of the primary barrel 6 is smaller than that of the secondary barrel 7, preferably at a ratio of up to 1 : 4. This provides an advantage in that while the primary metering system is functioning in the low to medium speed range a greater depression is provided at the primary venturi 8*a*. This promotes the evaporation of mixture through the main nozzle 9*a* which in turn reduces the inherent time delay from the time of application of control signal to the time of induction of mixture to the engine cylinders which results in improvement to stability.

Figure 2:
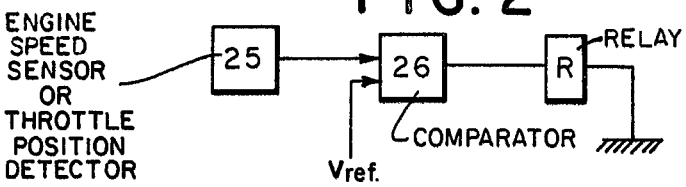
FIG. 2 is a schematic illustration of a switching circuit employed in the embodiment of FIG. 1.

In order to control the mixture effectively at different vehicle speeds, a relay contact $r_1$ is provided at the output of control circuit 17 to switchover the circuit between control valves 18*a* and 18*b*. The relay contact $r_1$ connects the output of control circuit 17 to the control valve 18*b* when the vehicle runs at a speed less than about 60 km/h (lower speed range) and changes over the connection to the valve 18*a* when that speed increases to the higher speed range. At lower speeds, therefore, feedback control is provided through the primary idling port 12*a* and at higher speeds the control is switched to the primary main nozzle 9*a*. To achieve this object, an engine speed sensor or a throttle position detector 25 (FIG. 2) is provided to generate a proportional electrical signal which is compared with a reference voltage by means of a comparator 26. An excessive signal above the reference level will operate a relay R which in turn operates its contact $r_1$ to changeover the control path to the main nozzle of the primary barrel 6.

Figure 3:
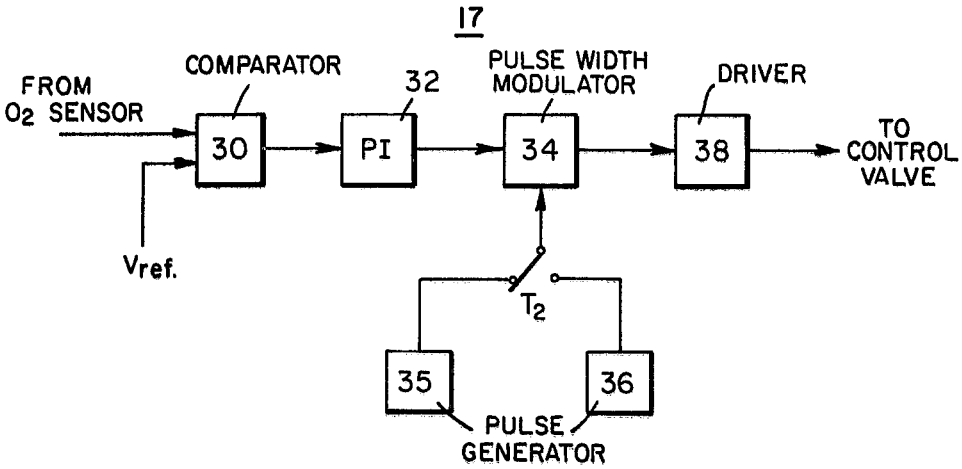
FIG. 3 is a functional block diagram of the control circuit of the FIG. 1 embodiment.

FIG. 3 illustrates an example of the control circuit 17 which includes a comparator 30, a proportional-integral controller 32 and a pulse width modulator 34. The comparator 32 has its one input connected to the output of oxygen sensor 15 and its other input connected to a source of reference voltage. The comparator will produce an output when the reference voltage is reached and feeds it to the proportional-integral controller 32 to generate an appropriate control voltage. A pulse generator 35 is connected to the pulse width modulator 34 by way of a normally closed path of a relay contact $r_2$ to convert the control voltage into pulsating control pulses whose pulse width is proportional to the input voltage. A second pulse generator 36 generating a signal at a frequency different from the frequency of generator 35, is connected to the modulator 34 through the normally open path of the relay contact $r_2$. This relay contact $r_2$ may be operated by the relay R or by a separate relay in relation to the engine speed to effect switching between the two pulse generators 35 and 36. The generator 35 operates when the vehicle runs at lower speeds to generate control pulses at a frequency determined from consideration of the engine revolution.

If the control valves 18*a* and 18*b* are operated at a frequency close to the engine frequency or rpm, oscillation may occur in the closed loop as a result of resonance between the two frequencies. Such oscillation leads to instability of the feedback control operation. In order to avoid the resonance, the frequency of the generator 35 is chosen to lie above the lower engine rpm, while the frequency of the second generator 36 is chosen at a value outside of the range of medium to higher engine rpm.

The pulse generator 36 will be connected to the modulator 34 when the relay R is operated to generate control pulses at the selected frequency outside the range of medium to higher engine rpm. The output of the pulse width modulator 34 is connected to a driver circuit 38 to amplify the pulse amplitude enough to operate the control valves. It is appreciated that when feedback control is provided through valve 18*b* the pulse generator 35 is brought into action and when the control is switched to the valve 18*a*, the pulse generator 36 is brought into action to take the place of generator 35.

Figure 4:
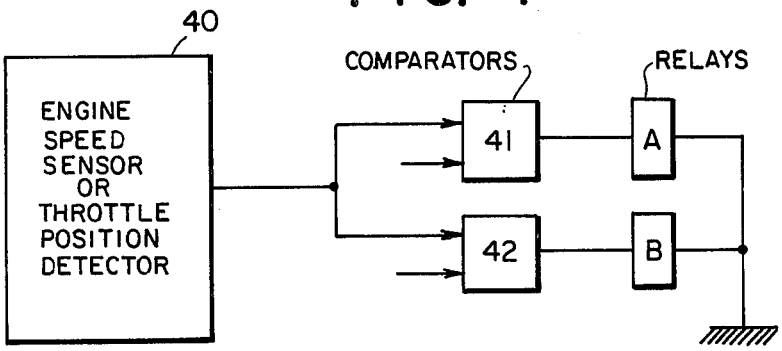
FIGS. 4 and 5 shows a circuit diagram for effecting smooth transition of switching between higher and lower operating frequencies.
Figure 5:
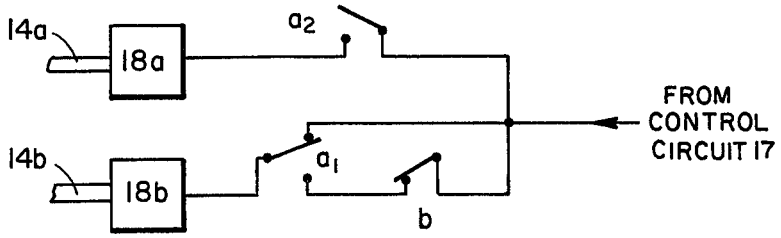
Figure 6:
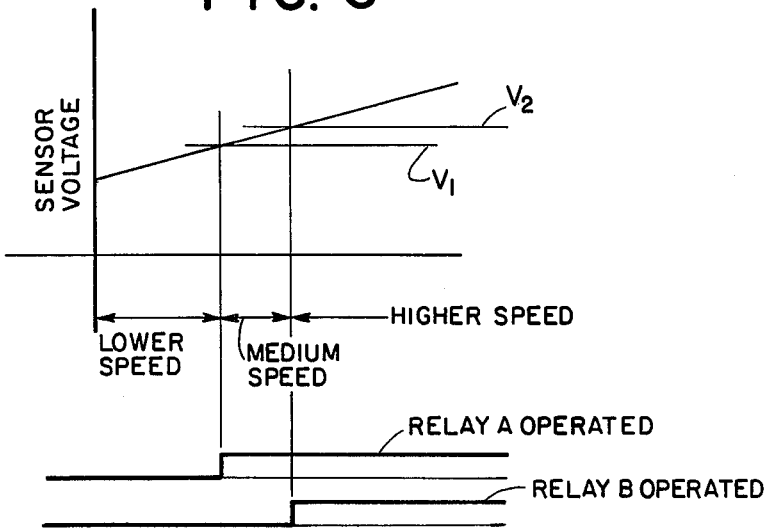
FIG. 6 is a graph showing the operation of the circuits of FIGS. 4 and 5.

To prevent the introduction of an abrupt change to the feedback control loop during the transitory period when relay R is activated, it is preferable to provide transitions in stages by employment of the circuit of FIGS. 4 and 5. In FIG. 4 comparators 41 and 43 are connected to the output of the engine speed sensor or throttle position detector 40 to produce outputs at different speed ranges to operate relays A and B whose contacts are connected in the circuit of FIG. 5. In FIG. 6 when the sensed voltage reaches $V_1$, which is smaller than $V_2$, comparator 41 produces an output which energizes relay A, and when $V_2$ is reached comparator 42 energizes relay B in addition to the operation of A. At lower vehicle speeds, the output of control circuit 17 is connected to the control valve 18*b* through the normally closed path of contact $a_1$ of relay A. At medium speeds, the voltage $V_1$ will be reached resulting in the operation of relay A. This couples the control circuit output to both valves 18*b* and 18*a* through contact *b* of relay B and the now closed path of contact $a_1$, and through contact $a_2$ of relay A respectively. When voltage $V_2$ is reached at higher speeds, relay B will be operated to open its contact *b* thus disconnecting the circuit for the valve 18*b*, while leaving the valve 18*a* to be operated. The voltage $V_2$ is selected at a suitable level to adjust the length of period during which both valves are operated.

What is claimed is:

1. A closed loop mixture control system for an internal combustion engine of a roadway vehicle, comprising:

a two-barrel carburetor having a primary barrel having a venturi and throttle and a secondary barrel in said carburetor for both receiving fuel and air when depression at the venturi of said primary barrel falls below a predetermined value, the cross-sectional dimension of the primary barrel being smaller than that of the secondary barrel so that evaporation of fuel inducted to the primary barrel is promoted as compared to the evaporation of fuel inducted to the secondary barrel;

means for producing a control signal corresponding to the difference between an air-fuel ratio of the mixture combusted in the engine and a stoichiometric air-fuel ratio of the mixture;

primary and secondary metering systems associated with the primary and secondary barrels, respectively, for proportioning air and fuel supplied to said engine, said primary metering system comprising a main mixture supply nozzle disposed in the venturi of the primary barrel, means defining an auxiliary mixture supply port disposed in the closed position of the throttle of the primary barrel, a first mixture control valve associated with said main mixture supply nozzle, a second mixture control valve associated with said auxiliary mixture supply port, a throttle position detector operatively connected to the throttle of the primary barrel, and means for selectively coupling said control signal to said first and second control valves in response to a predetermined throttle position of the primary barrel and effective so that said control signal is applied to the second control valve for part throttle operation and to the first control valve for full throttle operation; and means for controlling said primary metering system in accordance with said control signal.

2. A closed loop mixture control system for an internal combustion engine of a roadway vehicle, comprising:

a two-barrel carburetor having a primary barrel having a venturi and throttle and a secondary barrel in said carburetor for both receiving fuel and air when depression at the venturi of said primary barrel falls below a predetermined value, the cross-sectional dimension of the primary barrel being smaller than that of the secondary barrel so that evaporation of fuel inducted to the primary barrel is promoted as compared to the evaporation of fuel inducted to the secondary barrel;

means for producing a control signal corresponding to the difference between an air-fuel ratio of the mixture combusted in the engine and a stoichiometric air-fuel ratio of the mixture;

primary and secondary metering systems associated with the primary and secondary barrels, respectively, for proportioning air and fuel supplied to said engine, said primary metering system including a main mixture supply nozzle disposed in the venturi of the primary barrel, means defining an auxiliary mixture supply port disposed in the closed position of the throttle of the primary barrel, a first mixture control valve associated with said main mixture supply nozzle, a second mixture control valve associated with said auxiliary mixture supply port, an engine speed sensor, and means for selectively coupling said control signal to said first and second control valves in response to a predetermined engine speed effective so that said control signal is applied to the second control valve at lower engine speeds and to the first control valve at higher engine speeds; and means for controlling said primary metering system in accordance with said control signal.

3. A mixture control system as claimed in claim 2, wherein said means for producing a control signal comprises means for sensing a composition of the exhaust emissions from said engine to produce an output having a sharp characteristic change in amplitude at the stoichiometric air-fuel mixture ratio, means for modulating the amplitude of the output from the composition sensing means in accordance with predetermined amplification characteristics, and means for converting the amplitude-modulated signal to a train of pulses of which the pulse duration is dependent on said amplitude.

4. A mixture control system as claimed in claim 3, wherein said pulse converting means comprises a pulse width modulator coupled to said amplitude modulating means, and a source of generating a train of constant duration pulses to supply the same to said pulse width modulator to convert the amplitude modulated signal to a train of pulses at a frequency differing from the revolution per unit time of said engine.

5. A mixture control system as claimed in claim 4, wherein said pulse generating source comprises a first pulse generator generating pulses at a first frequency, a second pulse generator generating pulses at a second frequency differing from the first frequency, said first frequency being higher than the revolution per unit time of the engine at lower speeds, the second frequency being outside of the revolution per unit time of the engine at medium and higher speeds, and means coupling said first and second pulse generators selectively to said pulse width modulator in response to the throttle position of the primary barrel.

6. A mixture control system as claimed in claim 1, wherein said selectively coupling means includes means for coupling said control signal simultaneously to the first and second mixture control valves at said predetermined throttle position when the throttle of the primary barrel changes between part throttle position and full throttle position.

7. A mixture control system as claimed in claim 2, wherein said selectively coupling means includes means for coupling said control signal simultaneously to the first and second mixture control valves at said predetermined engine speed when the engine speed changes between lower and higher speeds.

* * * * *